US008919006B2

(12) United States Patent
Arrigoni et al.

(10) Patent No.: US 8,919,006 B2
(45) Date of Patent: Dec. 30, 2014

(54) LAUNDRY DRYING MACHINE WITH VIBRATING FLUFF FILTER

(75) Inventors: Giancarlo Arrigoni, Udine (IT); Carlo Urbanet, Sacile (IT); Alberto Bison, Pordenone (IT); Maurizio Ugel, Fiume Veneto (IT); Giancarlo Gerolin, S. Giovanni di Polcenigo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 606 days.

(21) Appl. No.: 13/003,788

(22) PCT Filed: Jun. 30, 2009

(86) PCT No.: PCT/EP2009/004695

§ 371 (c)(1),
(2), (4) Date: Feb. 17, 2011

(87) PCT Pub. No.: WO2010/006694

PCT Pub. Date: Jan. 21, 2010

(65) Prior Publication Data

US 2011/0173834 A1 Jul. 21, 2011

(30) Foreign Application Priority Data

Jul. 14, 2008 (EP) ..... 08012654

(51) Int. Cl.
*D06F 58/22* (2006.01)

(52) U.S. Cl.
CPC ..... *D06F 58/22* (2013.01)
USPC ..... 34/82; 34/85; 34/480

(58) Field of Classification Search
CPC ..... D06F 58/22; F26B 21/003; F26B 25/007; F26B 25/005; F26B 21/00
USPC ..... 34/86, 90, 95, 96, 63, 108, 250, 261, 34/318, 392, 425, 454, 499, 82, 85, 292, 34/300, 480; 310/27, 89; D32/8; 15/94; 95/282; 55/282
See application file for complete search history.

(56) References Cited

U.S. PATENT DOCUMENTS 3,304,624 A * 2/1967 Czech ..... 34/82
5,342,433 A * 8/1994 Avondoglio ..... 95/282

(Continued)

FOREIGN PATENT DOCUMENTS

DE 26 27 915 1/1978
DE 34 38 575 4/1986

(Continued)

OTHER PUBLICATIONS

International Search Report in corresponding PCT/EP2009/004695 mailed Oct. 26, 2009.

*Primary Examiner* — Kenneth Rinehart
*Assistant Examiner* — Tavia Sullens
(74) *Attorney, Agent, or Firm* — Banner & Witcoff, Ltd.

(57) ABSTRACT

A laundry drying machine (1) includes a casing (2) containing a rotatable drum (4) for holding the laundry (5) to dry, and a drying air circuit (6) for conveying a drying air flow towards the inside of the drum (6) and from it to the outside. At least one filter (12) is provided for intercepting the fluff dragged out of the laundry (5) by the drying air flow. Vibrating means (19) are adapted to cause the filter (12) to vibrate, so as to drop down the fluff from the filter (12). The filter (12) is selectively positionable between an operational position in which the filter (12) is arranged in a seat (11) intercepting the drying air circuit (6), and an extracted position in which the filter (12) is removed from the seat (11), outside the drying air circuit (6). The vibrating means includes an exciter, associated to the casing (2), and an exciter-responsive element, associated to the filter (12). The exciter and the exciter-responsive element are adapted to reciprocally cooperate in order to cause the filter (12) to vibrate when the filter (12) is in the operational position. The exciter and the exciter-responsive element are configured to allow the filter (12) to be extracted from and inserted in the seat (11).

21 Claims, 8 Drawing Sheets

(56) References Cited

U.S. PATENT DOCUMENTS

| | | | | |
|---|---|---|---|---|
| 5,938,965 | A * | 8/1999 | Madeira | 219/635 |
| 6,199,587 | B1 * | 3/2001 | Shlomi et al. | 137/625.5 |
| 2005/0184607 | A1 * | 8/2005 | Nakajima et al. | 310/81 |
| 2008/0235978 | A1 * | 10/2008 | Epstein | 34/82 |

FOREIGN PATENT DOCUMENTS

| | | | | |
|---|---|---|---|---|
| DE | 3438575 | A1 * | 4/1986 | D06F 58/22 |
| DE | 38 32 730 | | 4/1990 | |
| GB | 2072528 | A * | 7/1981 | B01D 46/04 |

* cited by examiner

LAUNDRY DRYING MACHINE WITH VIBRATING FLUFF FILTER

BACKGROUND OF THE INVENTION

The present invention refers to laundry drying machine with vibrating fluff filter.

Nowadays the laundry drying machines usually comprise a casing comprising an outer casing and a loading/unloading door in which it is defined a drying air circuit adapted to cause heated drying air to circulate through a rotating drum in which the laundry can be loaded, so as to remove the moisture from the laundry.

In particular there are known condenser-type drying machines in which the drying air circuit is typically provided with an air-cooled condenser, i.e. an air/air heat exchanger, adapted to remove moisture from the hot moisture-laden drying air exiting the drum, and with an open-loop cooling air circuit adapted to circulate through the air-cooled condenser a stream of cooling air taken in from the outside ambient to cool the condenser, and to let out said stream of cooling air again into the outside ambient.

Through the drying air circuit, the hot and moisture-laden drying air is caused to leave the rotating drum and is conveyed towards the air-cooled condenser; then, the dehydrated drying air exiting the condenser is sent back into the drum, upon having been duly heated up again, so as to remove additional moisture from the clothes being tumbled in the drum.

Heating means are provided downstream from the air-cooled condenser to heat up the dehydrated drying air due to be sent again into the drum.

They are also known laundry drying machines in which the treatment process of the drying air is based on the utilization of a heat pump that is substantially constituted by a refrigerating circuit including a motor-driven compressor, a condenser, an expansion valve and an evaporator. The condenser and the evaporator of this refrigerating circuit are usually arranged in the drying air circuit, upstream of the rotating drum of the machine.

Further component parts, such as appropriate heating elements to heat up the working media (refrigerant medium and drying air), condensate wells or traps, and the like, may be provided to the purpose of improving the efficiency of the machine and keep the energy usage thereof as low as possible.

In the previously described laundry drying machines, the drying air circuit usually includes filtering and collecting means for removing the fluff (named also lint) from the drying air.

Such filtering means are required in order to prevent fluff, or lint, from being able to settle and build up on the heat-exchange surfaces of the air-cooled condenser, thereby affecting the performance and the efficiency thereof. In addition, these filtering means prevent fluff from dangerously piling up on the heating means, so as to ward off any fire risk.

The filtering means, however, have a major drawback in that they tend to most easily become clogged in the course of the drying operation, thereby involving substantial pressure losses in the drying circuit and hence, a corresponding increase in the power required to ensure a predetermined, satisfactory flow rate through the same drying circuit, along with a substantial variation in the flow rate in the course of the drying operation and a reduction in efficiency.

Another drawback derives from the fact that, for the laundry dryer machine to be able to perform at the highest possible performance level it is capable of ensuring, the need arises for the user, after each drying cycle is ended, to submit the filtering means to due maintenance and cleaning.

However, users tend to dislike such maintenance and cleaning chore, since this requires them to directly handle, i.e. come into contact, with fluff; furthermore, it is generally felt as representing itself a waste of time.

It should also be stressed that the full efficiency and performance capability of the tumble dryer come to depend on the kind of maintenance ensured by the user, actually. The consequences of a poor maintenance, or a maintenance that is not carried out as frequently as necessary, are therefore fully obvious.

However, fluff is anyway and unavoidably retained by the filtering means during a drying process and such fluff unavoidably builds up a resistance to the flow of the drying air therethrough, with the result that the flow rate of the operative process air is anyway reduced and the drying time needed to complete the ongoing drying cycle is increased accordingly.

An insufficient cleaning of these filters, and the consequent clogging of the same, can therefore cause the deterioration of the drying performances of the machine, and moreover a significant increase of the temperature of the air inside the drum, which can be dangerous.

In order to overcome such a problem, various solutions have been proposed; for example in EP1719833 is disclosed a clothes drying machine comprising a rotating drum, holding the clothes to be dried, an outlet mouth, from which the drying air is released after having flown through the drum, an exhaust conduit, into which flows the air issuing from the outlet mouth, a lint filter, formed substantially in the shape of a sector of a cylindrical surface, which is arranged in the exhaust conduit below the outlet mouth of the drum, with the axis thereof extending substantially parallel to the axis of rotation of the drum, a stationary wall, which is at least partially applied on to the outlet mouth and is provided with a plurality of perforations for the air leaving the drum and entering the exhaust conduit to pass therethrough.

There are provided automatic means adapted to ensure cleaning of the filter, or a part thereof, through a brushing, i.e. wiping action; this automatic means comprise a brush, connected to an end portion of a moving arm, which is hinged, on the other end portion thereof opposite to the brush, on to a rotation pin. The moving arm is slidably linked with a driving pin, which is adapted to rotate, by means of a respective rotation arm, about a driving spindle driven rotatably about its own axis by automatic driving devices.

This solution is therefore based on the fact that the lint filter is periodically automatically cleaned in a mechanical way, at time intervals which are controlled by the machine operation program.

This kind of mechanical cleaning of the filter, although effective, is hindered by a number of specific drawbacks, in particular the complexity of the mechanical cleaning device, and the fact that the filtering septum, being very thin, is also fairly delicate, and so a reiterated brushing can damage it, reducing or also eliminating the filtering action.

Furthermore sometimes the brushing of the filtering septum, instead of removing the lint from the latter, could cause the lint to get stuck into the filtering septum, in such a way to occlude it, consequently obliging the user to disassemble the filter for manually cleaning it, for example using compressed air or other suitable devices. It is also known DE 3438575 in which is disclosed an appliance for the drying of laundry which has a horizontally and rotably mounted drum for receiving the laundry to be dried; a hot-air stream is conveyed diagonally through this drum.

To mechanically remove the laundry lint from the hot-air stream, there is provided, in the circuit of the hot air, a vertically suspended filter bag, from which the lint is detached at intervals, with the hot-air flow cut off, by means of a vibrating device, and then falls into a lint-collecting chamber which can be closed in a controlled manner.

The vibrating devices takes the filter bag in vibration, so as to separate the lint from the walls of this filter, and make it fall into the lint-collecting chamber, from where it can be periodically removed. The vibrating devices can be both a pneumatic device and an electromechanical device, connected to the upper part of the filter bag by means of springs.

Anyway also this appliance is affected by an important drawback; in fact the user can remove the filter bag only by partially disassembling the drying machine, this operation being quite difficult and requiring specific tools and a lot of time to be done.

On the contrary the possibility to easily remove the filter is very important, particularly because, in case of fault of the vibrating device, the filter must be anyway cleaned manually to avoid the above mentioned problems due to its clogging.

The difficulty in the removal of the filter also makes it difficult to verify if the cleaning operation made by the vibrating device has been really effective, of if some fluff has remained attached to the filter, which could generate the above mentioned problems related to the clogging of the filter.

With this solution it is also difficult to replace the filter bag in case of need (for example if the filter bag is broken).

An electromechanical device for setting in vibration a filter is also illustrated in DE 3832730 in which it is disclosed a shaking device for a dust collector with a vertically oriented cylindrical air-permeable filter which is held by an upper cylindrical support closed by a cover. The support can be set in vibration by a vibrator having an armature, a magnetic coil and a stator; the armature of the vibrator is arranged on the cover and the stator together with the magnetic coil, and can vibrate freely relative to the armature-cover unit.

Also this solution is affected by the drawback that in case of fault of the vibrating device, the removal of the filter for the manual cleaning of the same is quite difficult and time consuming, and also requires the use of specific tools.

SUMMARY OF SELECTED INVENTIVE ASPECTS

The aim of the present invention is to solve the above-noted problems, thereby doing away with the drawbacks of the cited prior art.

The Applicant has found that by obtaining a laundry drying machine provided with a fluff filter which can be selectively positioned between an operational position in which it is arranged in a seat intercepting the drying air circuit, and an extracted position in which it is removed from the seat, outside the drying air circuit, and by the usage of vibrating means comprising an exciter, associated to the casing of the laundry drying machine, and an exciter-responsive element, associated to the filter, which can reciprocally cooperate in order to cause the filter to vibrate when it is in the operational position, and which can also be configured to allow the filter to easily and quickly extracted from and inserted in the seat, it is possible to achieve the automatic cleaning of the filter, allowing at the same time an easy and quick manual removal and replacement of the filter.

In particular, the above-mentioned aim and objects, as well as others that will become better apparent hereinafter, are achieved by a laundry drying machine comprising a casing containing a rotatable drum for holding the laundry to dry, a drying air circuit for conveying a drying air flow towards the inside of the drum and from it to the outside, at least one filter for intercepting the fluff dragged out of the laundry by the drying air flow, vibrating means adapted to cause the filter to vibrate, so as to drop down the fluff from the filter; the filter is selectively positionable between an operational position in which the filter is arranged in a seat intercepting the drying air circuit, and an extracted position in which the filter is removed from the seat, outside the drying air circuit, the vibrating means comprising an exciter, associated to the casing, and an exciter-responsive element, associated to the filter, the exciter and the exciter-responsive element being adapted to reciprocally cooperate in order to cause the filter to vibrate when filter is in the operational position, the exciter and the exciter-responsive element being configured to allow the filter to be extracted from and inserted in the seat.

Preferably the exciter comprises a vibrating surface facing the exciter-responsive element when the filter is in the operational position so as to cooperate with the exciter-responsive element for causing the filter to vibrate.

Advantageously the vibrating surface directly contacts the exciter-responsive element when the filter is in the operational position, so as to transmit the vibration to the filter.

In a further embodiment, the exciter advantageously comprises a stinger protruding perpendicularly from the vibrating surface and arranged to push its free end against the exciter-responsive element when the filter is in the operational position.

In another embodiment the exciter comprises a first member of a male/female connector, and the exciter-responsive element comprises a second member of the male/female connector, the first member and the second member being arranged to removably engage each other when the filter is in the operational position, so as to mechanically connect the exciter and the exciter-responsive element, and allowing the transmission of the vibration to the filter.

In a further embodiment thereof, the exciter and/or the exciter-responsive element comprise at least a permanent magnet arranged to magnetically fasten the exciter and the exciter-responsive element one to the other.

Opportunely the exciter and/or the exciter-responsive element comprise a ferromagnetic surface adapted to magnetically engage the permanent magnet.

Advantageously the permanent magnet is associated to the vibrating surface and is arranged to magnetically fasten to a ferromagnetic surface of the exciter-responsive element comprising a ferromagnetic lateral wall of the filter facing the permanent magnet when the filter is in the operational position, or the ferromagnetic lateral surface of a spacing element protruding from the lateral wall facing the permanent magnet when the filter is in the operational position.

Preferably the exciter-responsive element comprises said permanent magnet adapted for allowing the matching with the exciter, the permanent magnet being associated to the lateral surface of said the filter facing the exciter when the filter is in the operational position, the exciter (19) comprising a ferromagnetic surface adapted to be magnetically fastened to the permanent magnet.

Advantageously the exciter is an electrodynamic actuator associated to a lateral wall of the seat and comprising a solenoid coil adapted to electromagnetically interact with a movable permanent magnet so as to cause the permanent magnet to vibrate.

In a further embodiment the exciter and the exciter-responsive element are arranged to electromagnetically interact when the filter is in the operational position, so as to cause the exciter-responsive element to vibrate with respect to the exciter.

Opportunely the exciter comprises a first solenoid coil for generating an alternated magnetic field, the exciter-responsive element comprising a permanent magnet and/or a ferromagnetic element and/or a second solenoid coil arranged to electromagnetically interact with the alternated magnetic field generated by the first solenoid coil when the filter is in the operational position, so as to cause the exciter-responsive element to vibrate.

Preferably the exciter comprises a flux concentrator around which it is wound the first solenoid coil, and/or a further permanent magnet, disposed substantially concentrically to the first solenoid coil.

Advantageously the exciter-responsive element comprises a spacing element adapted to interact with the exciter so as to cause the filter to vibrate.

Opportunely below the filter it is associated a removable container adapted to collect the fluff dropping down from the filter due to the vibrations.

BRIEF DESCRIPTION OF THE DRAWINGS

Features and advantages of the present invention will anyway be more readily understood from the description that is given below by way of non-limiting example with reference to the accompanying drawings, in which.

DETAILED DESCRIPTION OF EXAMPLE EMBODIMENTS

It must be noted that, even if the following description will concern a front-loader drying machine (particularly of the condenser-type), it will be understood that the invention may be applied also to any combined washing- and drying machine, as well as to an only drying machine, both top- and front-loader, and both vertical and horizontal axis.

Figure 1:
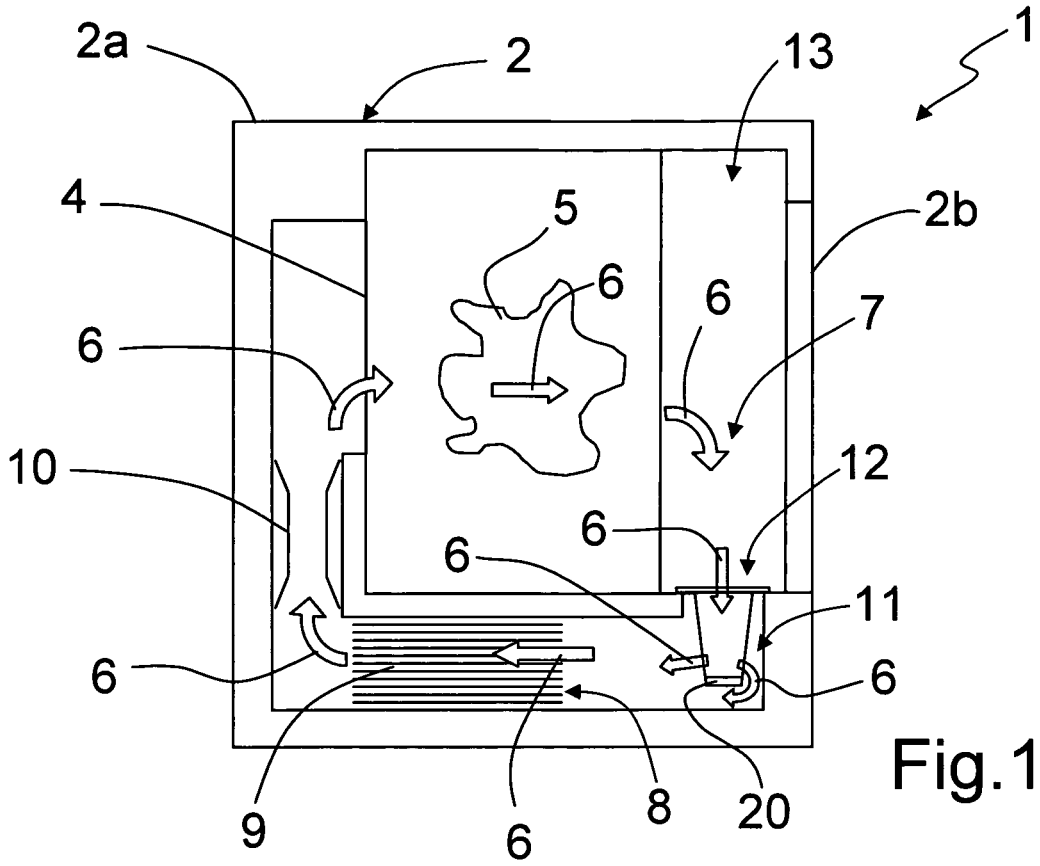
FIG. 1 is a simplified schematic lateral view, partially sectioned, of the conduits of a laundry drying machine according to the invention, with the filter in the operational position.
Figure 2:
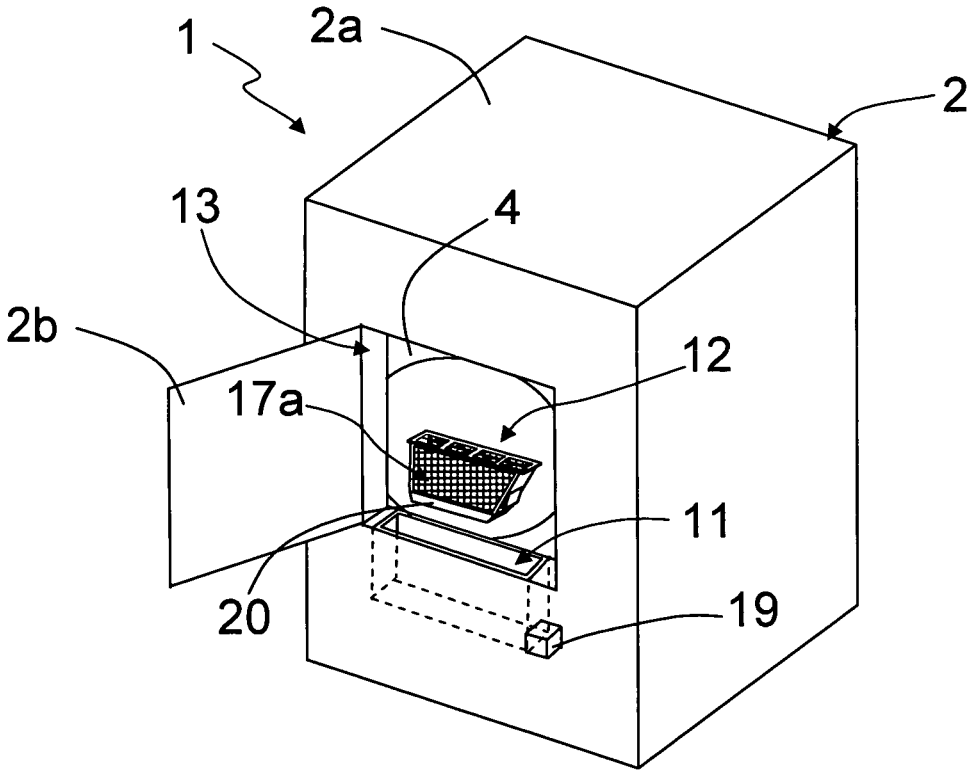
FIG. 2 is a simplified schematic perspective view of a laundry drying machine according to the invention, with the filter in the extracted position.

In FIGS. 1 and 2 is schematically illustrated a laundry drying machine 1 according to the invention, comprising a casing 2 comprising an outer casing 2*a* provided with a loading/unloading port 2*b* and containing a rotatable drum 4 for holding the laundry 5 to dry.

The laundry drying machine 1 comprises a drying air circuit (schematically indicated in FIG. 1 with the arrows indicated by the reference number 6) for conveying a drying air flow towards the inside of the rotatable drum 4 and from it to the outside.

As mentioned above, the laundry drying machine illustrated in FIG. 1 is a front-loader drying machine of the condenser-type; in this case the drying air circuit 6 comprises an exhaust conduit 7, fluidly-connected to the rotatable drum 4 for the outflow of the drying air, which is in turn fluidly-connected to a re-circulation conduit 8 provided with a condenser 9 followed by a heater 10. The re-circulation conduit 8 is fluidly connected to the rotatable drum 4 for admitting in it the drying air deprived of moisture (by the condenser 9, which could be for example an air/air heat exchanger or an evaporator of a heat pump) and heated (by the heater 10, which can advantageously be in the form of a condenser of a heat pump or of a further electric resistance).

The exhaust conduit 7 is fluidly connected to one or more seats 11, obtained in the outer casing 2*a* and/or in the loading/unloading port 2*b*, in which can be placed one or more filters 12 adapted to intercept the fluff and other small particles (not illustrated) dragged out of the laundry 5 by the drying air flow.

In the embodiment illustrated in the enclosed Figures, the laundry drying machine 1 comprises only one seat 11, advantageously substantially parallelepiped-shaped, obtained in the outer casing 2*a*, preferably in the lower region of the loading/unloading opening 13.

In another embodiment, not illustrated, in which the drying air circuit 6 is fluidly connected to the loading/unloading port 2*b*, the seat 11 can also be obtained inside said loading/unloading port 2*b*, which integrally forms a portion of the drying air circuit 6.

In the examples illustrated in the enclosed Figures, the filter 12 is advantageously box-shaped, hollow, and has a substantially truncated-pyramidal configuration.

On the upper surface 14 of the filter 12 there are provided one or more openings 15 for the admission of the drying air into the filter 12 after the passage through the laundry 5 contained in the drum 4.

Advantageously, at least a portion of at least a first lateral wall 16*a* of the filter 12 comprises a filtering septum 17*a*, preferably made of a thin and very close-mesh net, adapted to block the passage to the fluff and to other small particles dragged out of the laundry 5 by the drying air flow.

In the embodiment represented in the enclosed Figures a first lateral wall 16*a* of the filter 12 comprises advantageously a filtering septum 17*a*, which almost fills the whole surface of the first lateral wall 16*a*, with the exception of a thin frame, and also a second lateral wall 16*b*, substantially parallel to the first lateral wall 16*a*, comprises advantageously a filtering septum 17*b* which almost totally fills the second lateral wall 16*b* with the exception of a thin frame.

As can be seen in FIG. 1, after exiting the drum 4, the drying air, full of moisture, fluff, and other small particles, enters the filter 12 through the apertures 15, and gets into the re-circulation conduit 8, after passing through the filtering septa 17*a*, 17*b*, which retain the fluff and the other small particles.

The filter 12 is removably and slidably arranged in the seat 11; the filter 12 is therefore selectively positionable between an operations position, illustrated for example in FIGS. 1, 6, 7, 10, 12, 17 in which it is arranged in the seat 11 to intercept the drying air circuit 6, and an extracted position, illustrated for example in FIGS. 2, 5, 8, 11 in which said filter 12 is removed from the seat 11, outside the drying air circuit 6.

Advantageously, from the upper perimetrical border of the filter 12 protrudes a perimetrical appendix 18, adapted to rest on the perimetrical border of the seat 11 in the operational position.

The laundry drying machine 1 comprises vibrating means, which will be described in the following, adapted to cause the filter 12 to vibrate, so as to drop down the fluff and other small particles from the filtering septa 17*a*, 17*b* of the filter 12.

Advantageously the vibrating means comprises an exciter, associated (i.e., attached, directly or indirectly) to the casing 2, and an exciter-responsive element, associated to the filter 12, adapted to reciprocally cooperate in order to cause the filter 12 to vibrate when it is in the operational position, and are also configured to allow the filter 12 to be extracted from and inserted in the seat 11 in a very easy and quick way, without need of specific tools.

Advantageously, below the filter 12 it can be associated a removable container 20, adapted to collect the fluff dropping down from the filter 12 due to the vibrations.

When, after one or more drying cycles and automatic cleaning (obtained by means of the vibrating means) of the filter 12, the removable container 20 is full of fluff, the filter 12 can be easily removed from the seat 11, so as to keep it in the extracted position, and the container 20 can be temporally removed from the filter 12 so as to allow the removal of the fluff.

Figure 4:
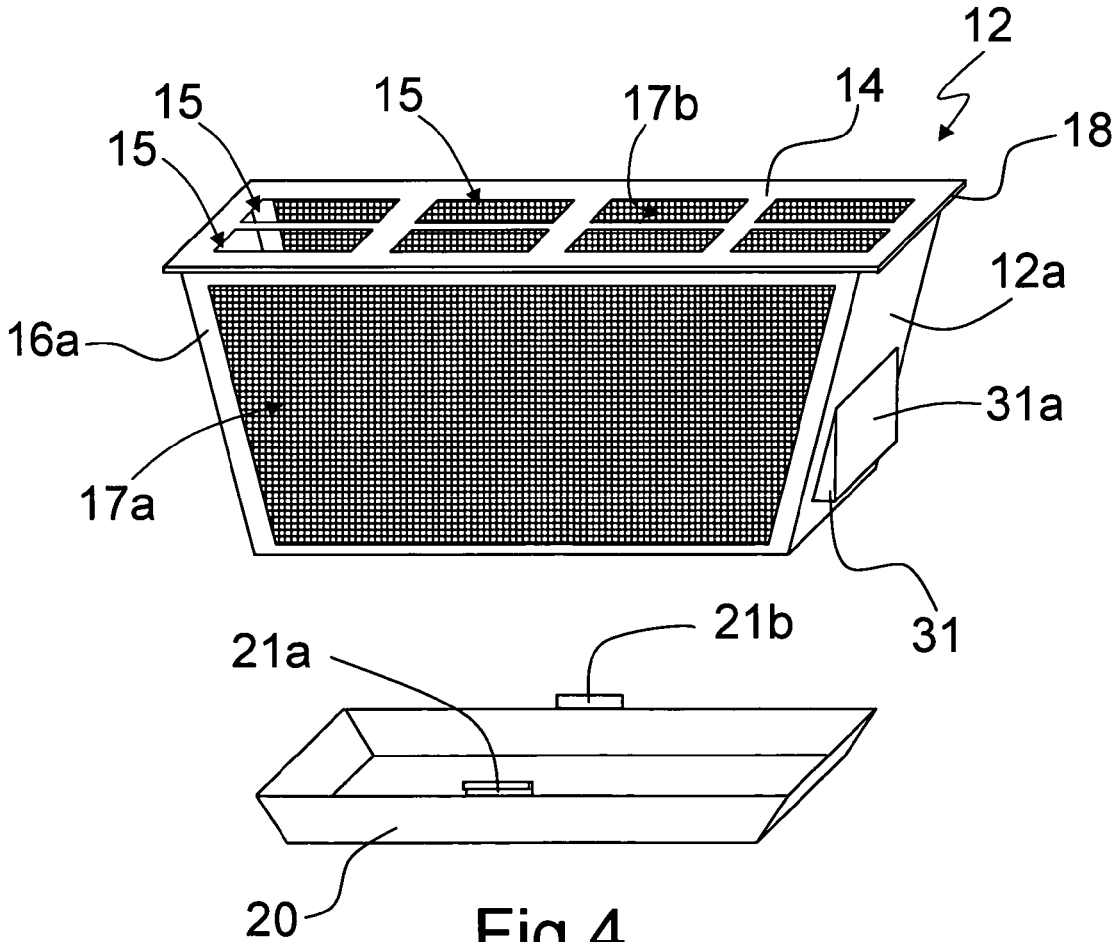
FIG. 4 illustrates, in an "exploded" view, the filter of FIG. 3.

The removable container 20 can be for example connected to the filter 12 by snap-fitting means, which can be constituted, for example, by two reverse L-shaped fins 21*a*, 21*b*, protruding from the perimetrical border of two parallel lateral walls of the container 20, which can be snap-fitted into as many suitable housings (not illustrated), obtained in the inner surface of two parallel lateral walls of the filter 12 (in the example illustrated in FIG. 4 these housings are obtained in the inner surfaces of the first and second lateral wall 16*a*, 16*b*).

Alternatively, in a further embodiment (not illustrated), the removable container 20 could be slidably coupled to the filter 12, for example by sliding means advantageously comprising two slides, not illustrated, obtained in the inner surface of two parallel lateral walls of the container 20, in which can be slidably introduced two counter-shaped ribs (also not illustrated), obtained in the outer surface of two corresponding lateral walls of the filter 12.

Figure 5:
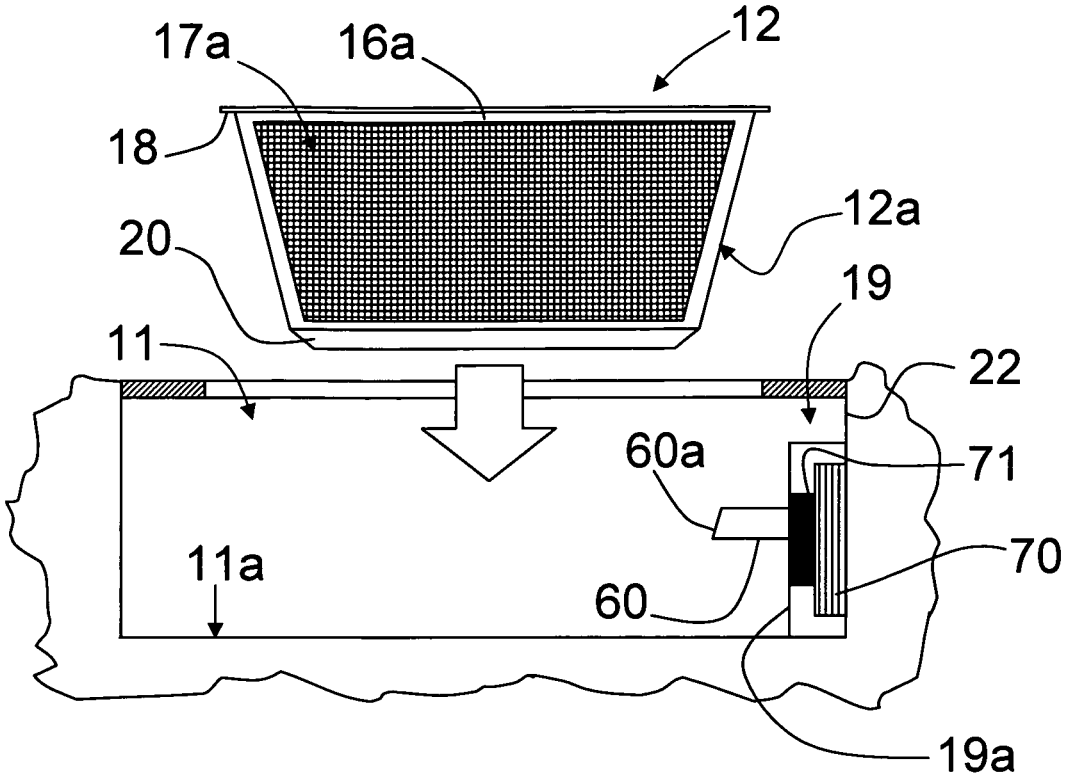
FIG. 5 illustrates, in a lateral view partially sectioned, a filter of a first embodiment of a laundry drying machine according to the invention in the extracted position.
Figure 6:
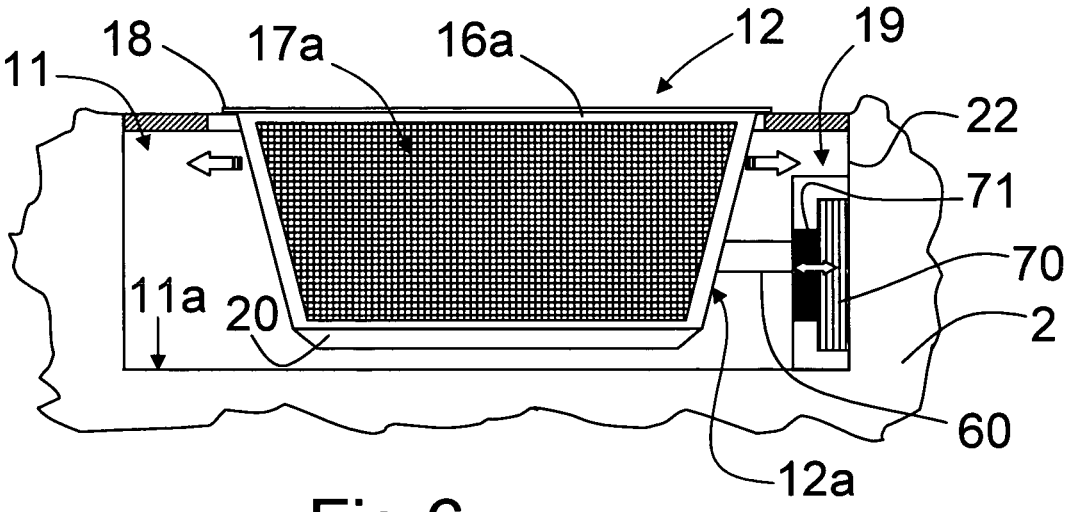
FIG. 6 illustrates, in a lateral view partially sectioned, the filter of FIG. 5 in the operational position.

In FIGS. 5 and 6 is illustrated a first embodiment of the invention in which the exciter (indicated with the reference number 19) is applied to a lateral wall 22 of the seat 11, so as to face the filter 12 when the latter is placed inside the seat 11 in the operational position.

In this case the exciter 19 is a device adapted to autonomously vibrate if activated by suitable driving means which can comprise, for example, the electronic control (not illustrated) of the laundry drying machine 1.

Advantageously the driving means for activating the exciter 19 can also comprise a dedicated command which can be manually activated by the user, or an automatic vibrating function programmed in the electronic control of the laundry drying machine 1 for causing the filter 12 to vibrate before and/or after each drying cycle.

Advantageously the exciter 19 comprises a vibrating surface 19*a*, facing the filter 12 when it is placed inside the seat 11 in the operational position, which can vibrate in a direction adapted to cause the filter 12 to vibrate without exiting from the seat 11; as can be see for instance in FIGS. 5 and 6, the vibrating direction of the vibrating surface 19*a* is advantageously substantially perpendicular to the inserting direction of the filter 12 in the seat 11.

Advantageously, as schematically illustrated in FIGS. 5 and 6, the exciter 19 could be an electrodynamic actuator, fixed to the lateral wall 22 of the seat 11; this electrodynamic actuator can be advantageously of the type used in conventional moving coil loudspeakers, comprising a solenoid coil 70, fixable to the lateral wall 22 of the seat 11, a movable permanent magnet 71, associated to the vibrating surface 19*a*, and a suspension (not illustrated); when the solenoid coil 70 is feed with an alternated current, it generates an alternating magnetic field that made the permanent magnet 71, and consequently the vibrating surface 19*a*, to vibrate.

According to the characteristic of the current, the permanent magnet 71, and also the vibrating surface 19*a*, can be set in vibration in a very wide range of vibration frequencies.

In a different embodiment, not illustrated, the exciter 19 can also be a pneumatic or hydraulic device, for example a pneumatic piston, operated by an apposite pneumatic or hydraulic circuit (both not illustrated).

In the embodiment illustrated in FIGS. 5 and 6 the exciter 19 comprises also a stinger 60 protruding perpendicularly from the vibrating surface 19*a*, so as to face the filter 12 when it is in the operational position.

In this case the exciter-responsive element advantageously comprises the lateral wall 12*a* of the filter 12 which faces, when the filter 12 is in the operational position, the exciter 19; as can be seen in FIG. 6, when the filter 12 is in the operational position, the free end 60*a* of the stinger 60 pushes against the lateral wall 12*a* of the filter 12 (which forms the exciter-responsive element), so as to transmit to this last the vibration generated by the exciter 19.

In this embodiment, the stinger 60 only applies a pressure to the exciter-responsive element, causing the filter 12 to move only in one direction opposite to the exciter 19; the movement of the filter 12 towards the exciter 19 could in this case be obtained by suitable reaction means, which could advantageously comprise, for example, a spring, not illustrated, interposed between the filter 12 and the lateral wall of the seat 11 opposite to the lateral 22 to which it is associated the exciter 19, so as to push the filter 12 towards the stinger 60.

The movement of the filter 12 towards the stinger 60 could also be obtained by an opportune configuration of the filter and/or of the seat 11, adapted to force the filter 12 towards the stinger 60; for example the perimetrical border of the seat 11 could be skewed, so as to cause the filter 12 to move towards the exciter 19 by gravity's effect.

Alternatively the movement of the filter 12 towards the stinger 60 could also be generated by the intrinsic elasticity of the walls of the filter 12, which cause the walls of the filter 12 to vibrate as a consequence of the impulsive pressure cyclically applied by the stinger 60.

Figure 7:
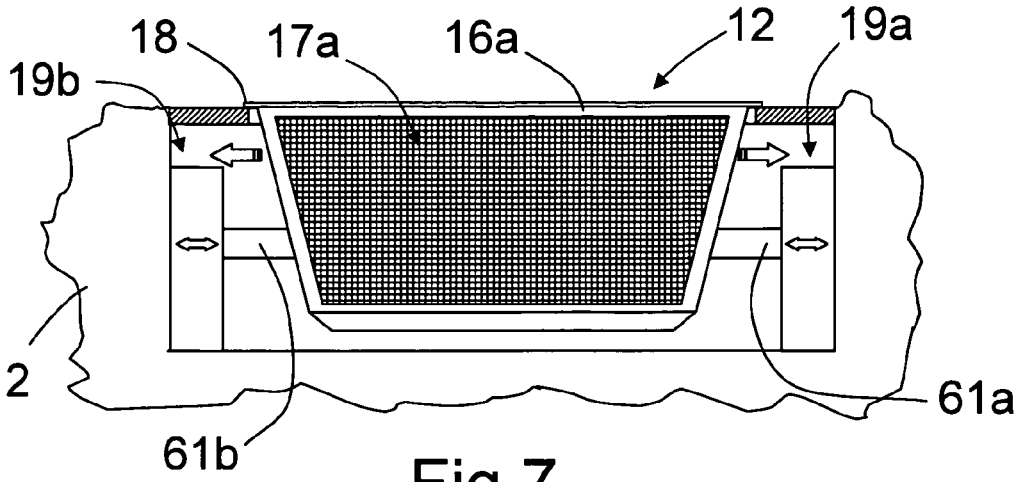
FIG. 7 illustrates, in a lateral view partially sectioned, a filter of a further embodiment of a laundry drying machine according to the invention in the operational position.

In another embodiment, illustrated in FIG. 7, the filter 12 could be set in vibration by two exciters 19*a*, 19*b*, associated to opposite lateral walls of the seat 11, each one provided with a stinger 61*a*, 61*b* pushing against a respective exciter-responsive element associated to the filter 12, and arranged for vibrating in phase opposition (i.e. when one stinger 61*a* is moving in one direction the other stinger 61*b* is moving in the opposite direction), so as to cause the filter 12 to vibrate.

Figure 3:
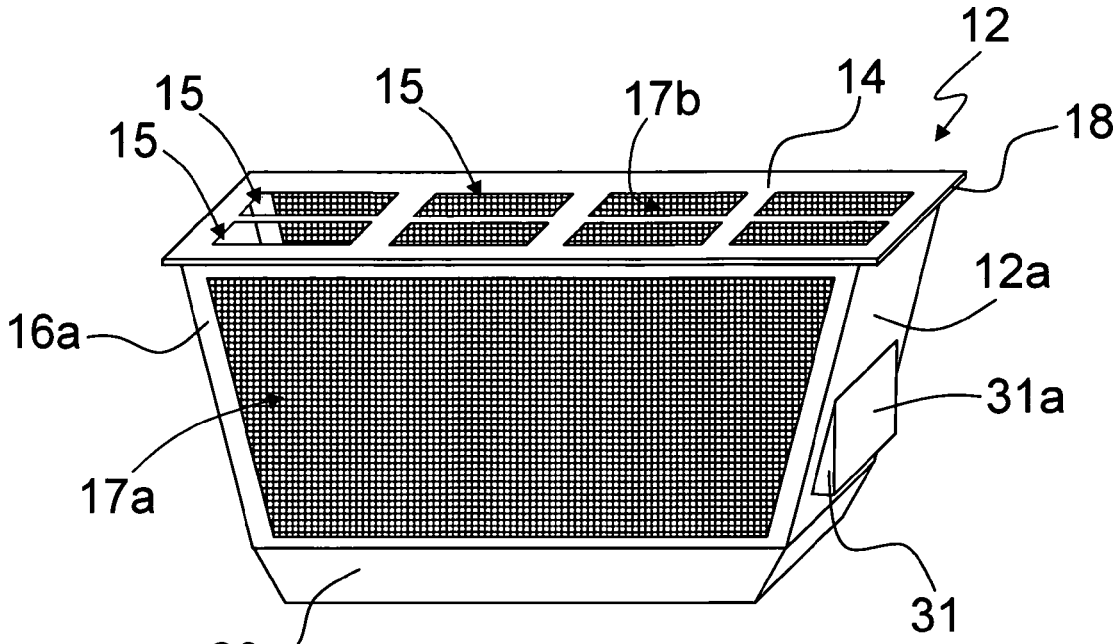
FIG. 3 is a perspective view a filter of a laundry drying machine according to the invention.

In a further embodiment the exciter-responsive element could also comprise a spacing element 31, illustrated for example in FIGS. 3 and 4, protruding from the lateral wall 12*a* of the filter 12, so as to be contacted by the stinger 60 when the filter 12 is in the operational position.

In another embodiment, also not illustrated, the stinger 60 is not present, and the vibrating surface 19*a* of the exciter 19 directly pushes against the exciter-responsive element (i.e. the wall 12*a* or the spacing element 31) when the filter 12 is placed inside the seat 11 in the operational position. Also in this case the exciter 19 only applies a pressure to the exciter-responsive element, causing the filter 12 to move only in one direction, opposite to the exciter 19; the movement of the filter 12 towards the exciter 19 could therefore be obtained by suitable reaction means (e.g. a spring), or by an opportune configuration of the filter 12 and/or of the seat 11, or thanks to the intrinsic elasticity of the walls of the filter 12, or by the use of two exciters, arranged for vibrating in phase opposition and associated to opposite lateral walls of the seat 11, so as to push against two corresponding exciter-responsive element associated to the filter 12.

In a further embodiment, not illustrated in the enclosed Figures, the exciter could also be associated to the casing 2 at least partially outside the seat 11; in this case, the stinger 60 could be inserted in the seat 11, so as to interact with the exciter-responsive element, via suitable hole obtained in a wall of the seat 11.

Figure 8:
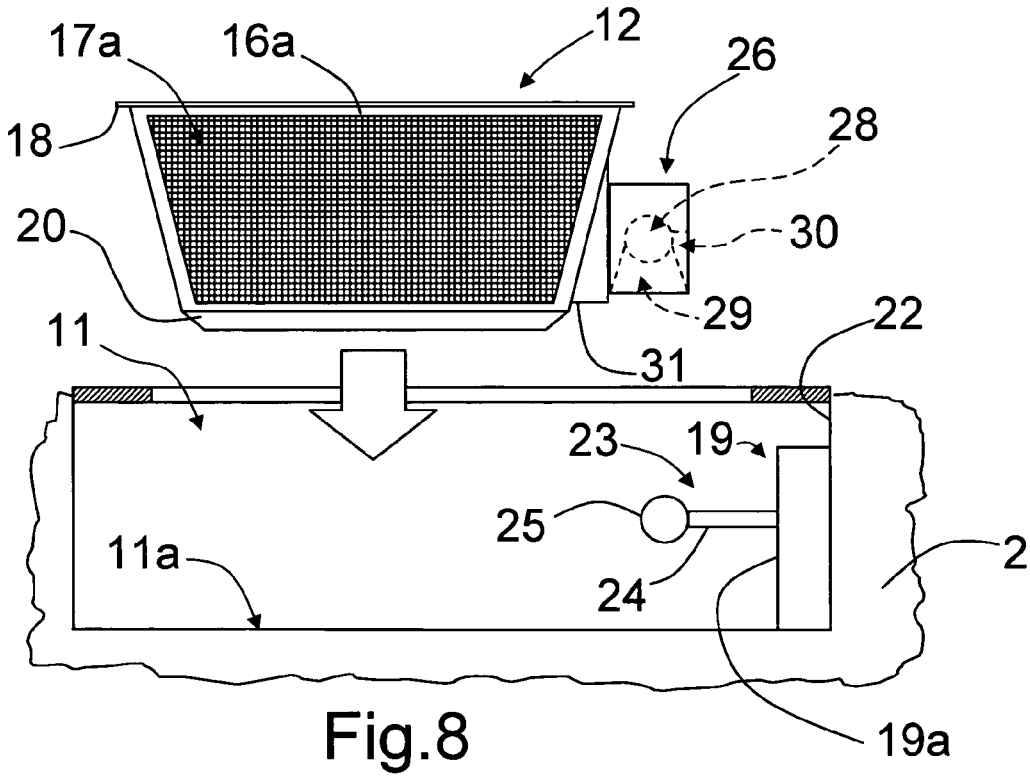
FIG. 8 illustrates, in a lateral view partially sectioned, a filter of a further embodiment of a laundry drying machine according to the invention in the extracted position.
Figure 9:
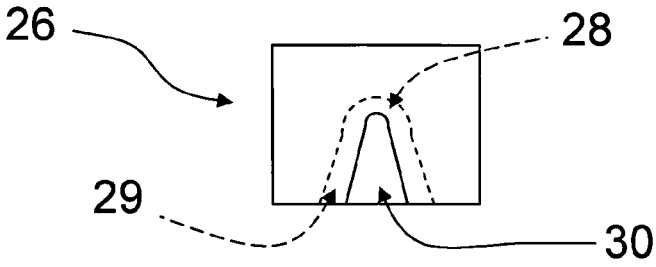
FIG. 9 illustrates, in a frontal view, a component of the exciter-responsive element of the laundry drying machine of FIG. 8.
Figure 10:
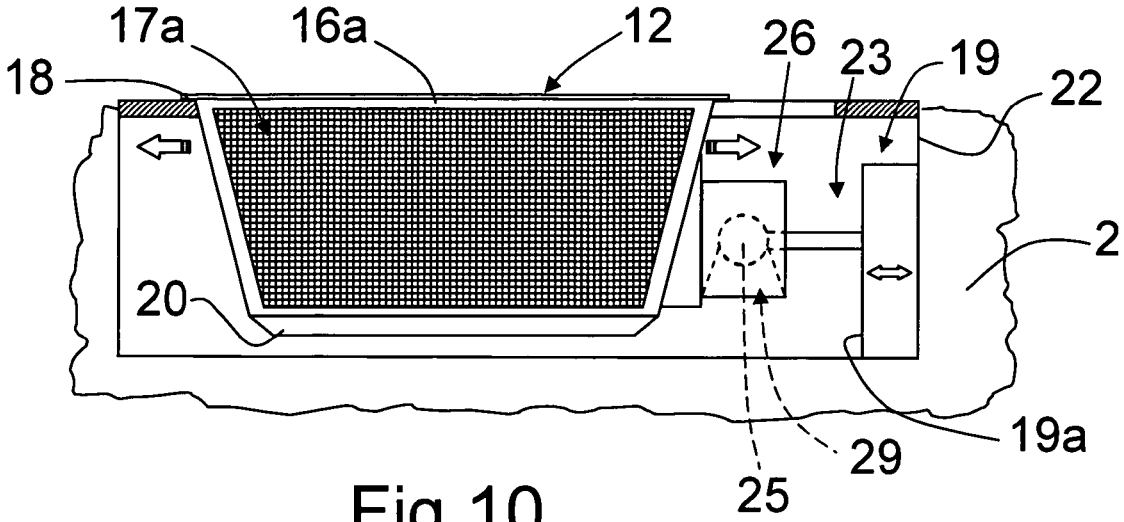
FIG. 10 illustrates, in a lateral view partially sectioned, the filter of FIG. 9 in the operational position.

In another embodiment, illustrated in FIGS. 8, 9 and 10, the exciter 19 is again a device adapted to autonomously vibrate (if activated by suitable driving means), like an electrodynamic actuator or a pneumatic or hydraulic device.

In this case the exciter 19 associated to the casing 2 comprises a first member 23 of a male/female connector, and the exciter-responsive element, associated to the filter 12, comprises a second member 26 of said male/female connector; when the filter 12 is placed inside the seat 11, in the operational position, the first member 23 engages the second member 26, mechanically connecting the exciter 19 and the exciter-responsive element, thus allowing the transmission of the vibration to the filter 12, and also its easy and quick extraction from and insertion in the seat 11.

In the embodiment illustrated in FIGS. 8, 9 and 10, the first member 23 of the male/female connector comprises advantageously a pin 24, protruding from the vibrating surface 19*a* and provided, at his free end, with a head 25, preferably spherical.

The second member 26 of the male/female connector is advantageously secured to the spacing element 31 protruding from the lateral wall 12*a* of the filter 12 facing the exciter 19 in the operational position; inside the second element 26 it is obtained a spherical cavity 28, adapted to contain the head 25 of the male connector 23, communicating with a lower channel 29, opened toward the bottom 11*a* of the seat 11, which is flared-shaped so as to constitute an invitation to the insertion of the head 25.

Both the spherical cavity 28 and the lower channel 29 communicate with a frontal opening 30, substantially triangular, allowing the passage of the pin 24.

The oblique shape of the lower channel 29 and of the frontal opening 30 allows an easy connection of the male and the female connectors.

Naturally, in a different embodiment, the pin 24 could be associated to the exciter-responsive element and the second member 26 could be associated to the exciter 19.

In another embodiment (again not illustrated), one vibrating device can be fixed to the bottom 11*a* of the seat 11, so as to get in vibration the filter 12 according to an axis perpendicular to the bottom 11*a* of the seat 11.

Figure 11:
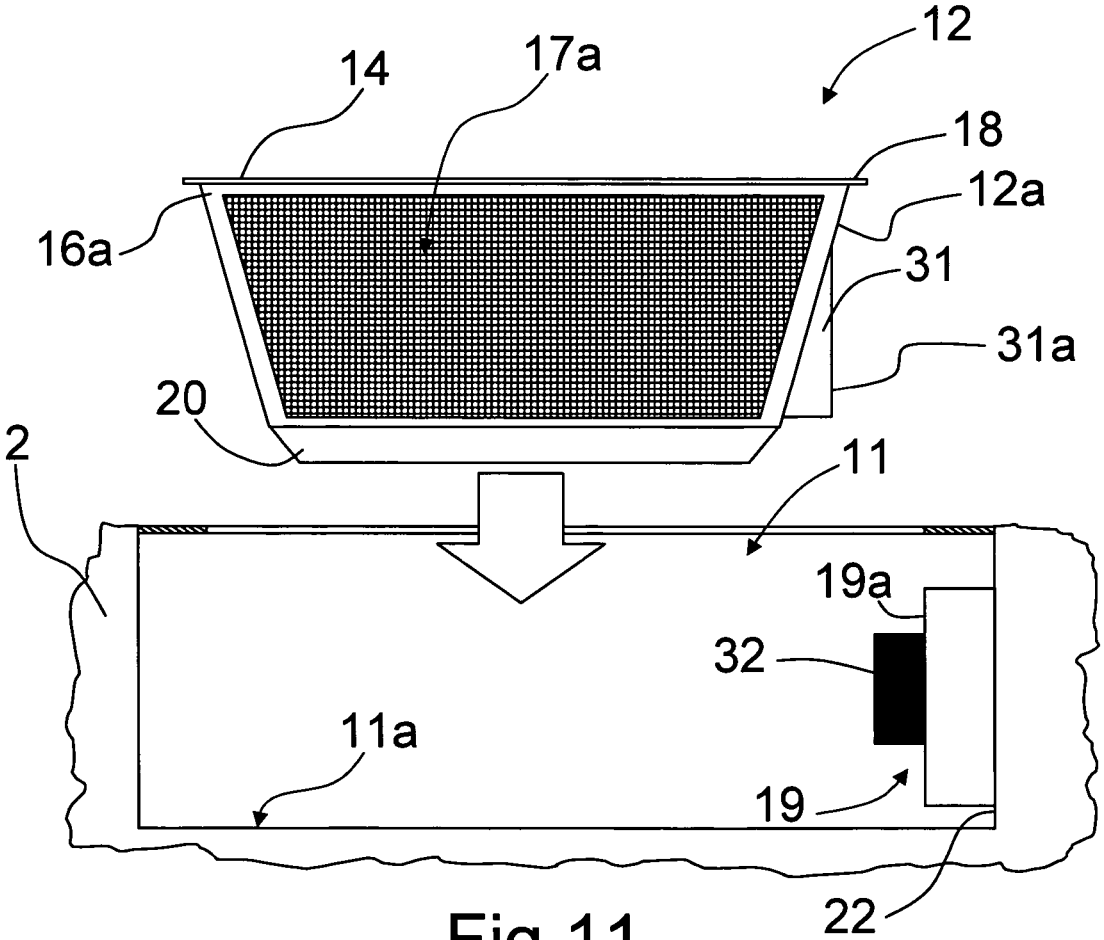
FIG. 11 illustrates, in a lateral view partially sectioned, a filter of a another embodiment of a laundry drying machine according to the invention in the extracted position.
Figure 12:
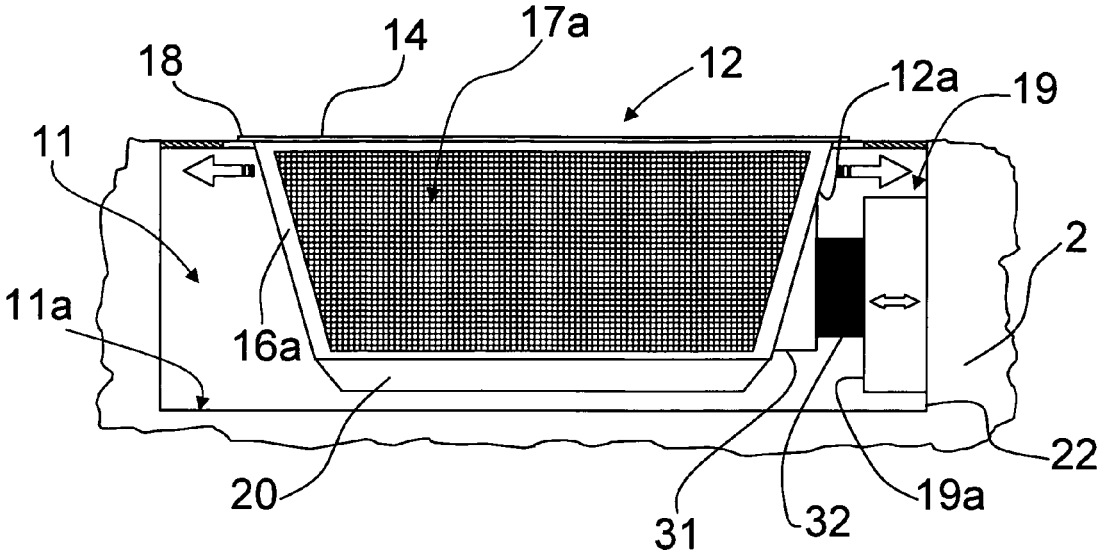
FIG. 12 illustrates, in a lateral view partially sectioned, the filter of FIG. 11 in the operational position.

In FIGS. 11 and 12 is illustrated another embodiment of the invention, in which the exciter 19 is again a device adapted to autonomously vibrate (if activated by suitable driving means), like an electrodynamic actuator or a pneumatic or hydraulic device.

In this case the exciter 19 associated to the casing 2, and the exciter-responsive element associated to the filter 12 can be removably coupled, when the filter 12 is in the operational position, by means of at least a permanent magnet 32 arranged between them.

In the embodiment illustrated in FIGS. 11 and 12, the permanent magnet 32 is advantageously firmly joined to the vibrating surface 19*a*, for example by gluing, and is arranged to magnetically fasten to a ferromagnetic surface of the exciter-responsive element associated to the filter 12, when this last is placed inside the seat 11 in the operational position.

In the embodiment illustrated in FIGS. 11 and 12 the exciter-responsive element comprises a spacing element 31, protruding from the lateral wall 12*a* of the filter 12 facing the exciter 19 when it is in the operative position, which, in this case, is advantageously made of a ferromagnetic material; in this case the ferromagnetic surface of the exciter-responsive element adapted to be magnetically fastened to the permanent magnet 32 is the lateral surface 31*a* of the spacing element 31 facing the exciter 19 when the filter 12 is in the operational position.

When the filter 12 is introduced into the seat 11, the permanent magnet 32 magnetically connects the exciter 19 and the exciter-responsive element setting automatically these two components in a reciprocal position suitable for allowing the transmission of the vibration; therefore the positioning of the filter 12 in the seat 11 and its connection to the vibrating device 19 is very fast and easy, not requiring a-particular attention from the user.

Advantageously the permanent magnet 32 is arranged in such a way that its magnetic force acts mainly in a direction perpendicular to the inserting direction of the filter 12 into the seat 11, so as to ensure an effective vibrating connection between the filter 12 and the seat 11 during the vibration; on the contrary the magnetic force is very low in the direction perpendicular to the bottom II a of the seat 11, and therefore the filter 12 can be easily extracted from and inserted in the seat 11 and placed in the extracted position simply by a traction in this direction.

In a further embodiment not illustrated, the lateral wall 12*a* of the filter 12 facing the exciter 19 when the filter 12 is in the operational position is made of a ferromagnetic material; in this case the spacing element 31 would not have to be present, and the ferromagnetic surface of the exciter-responsive element adapted to be magnetically fastened to the permanent magnet 32 could be the lateral wall 12*a* itself.

Advantageously, in another embodiment, also not illustrated, the exciter 19 comprises an electrodynamic actuator (for example like the one illustrated with reference to FIGS. 5 and 6) containing a movable permanent magnet 32 which in this case has the double function to cause the vibrating surface 19*a* to vibrate and to allow the magnetic fastening of the exciter and the exciter-responsive element.

In fact in this case the magnetic flux of the permanent magnet 32 of the electrodynamic actuator crosses the vibrating surface 19*a*, so as to magnetically link with the ferromagnetic surface of the exciter-responsive element.

In another embodiment, not illustrated, the exciter-responsive element can comprise the permanent magnet 32, adapted for joining the exciter 19 which in this case comprises a ferromagnetic surface adapted to be magnetically fastened to the permanent magnet. This ferromagnetic surface could advantageously be the vibrating surface 19*a*, or the ferromagnetic surface of a further ferromagnetic element, not illustrated, associated to said vibrating surface 19*a*.

In another embodiment, also not illustrated, both the exciter and the exciter-responsive element comprise a permanent magnet, arranged to magnetically fasten to the other when the filter 12 is placed in the operational position.

Figure 13:
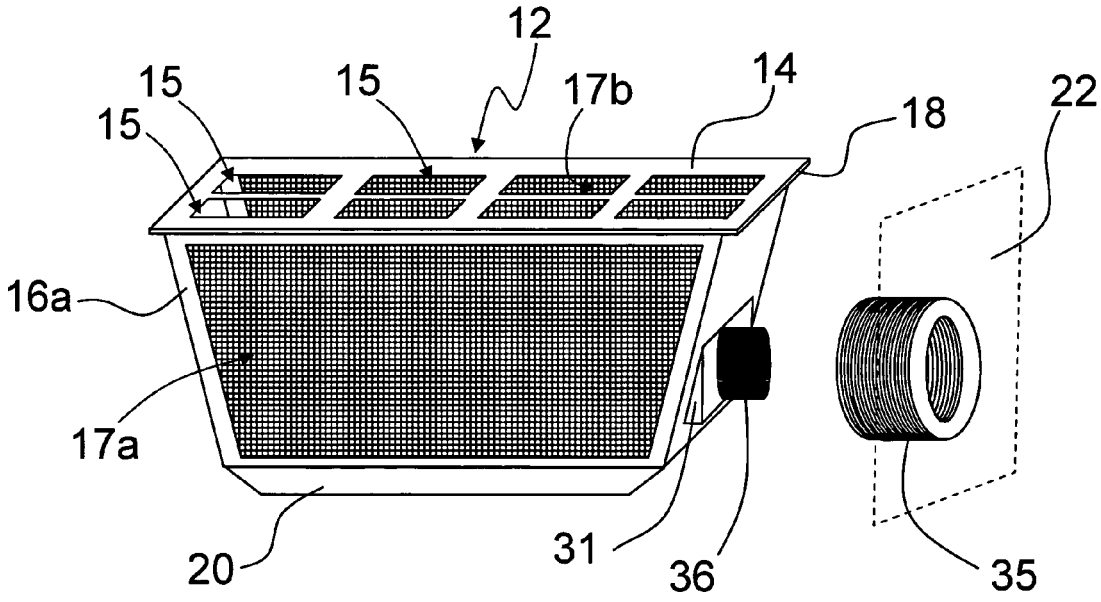
FIG. 13 illustrates, in a perspective view, a filter and the vibrating means of another embodiment of a laundry drying machine according to the invention.
Figure 14:
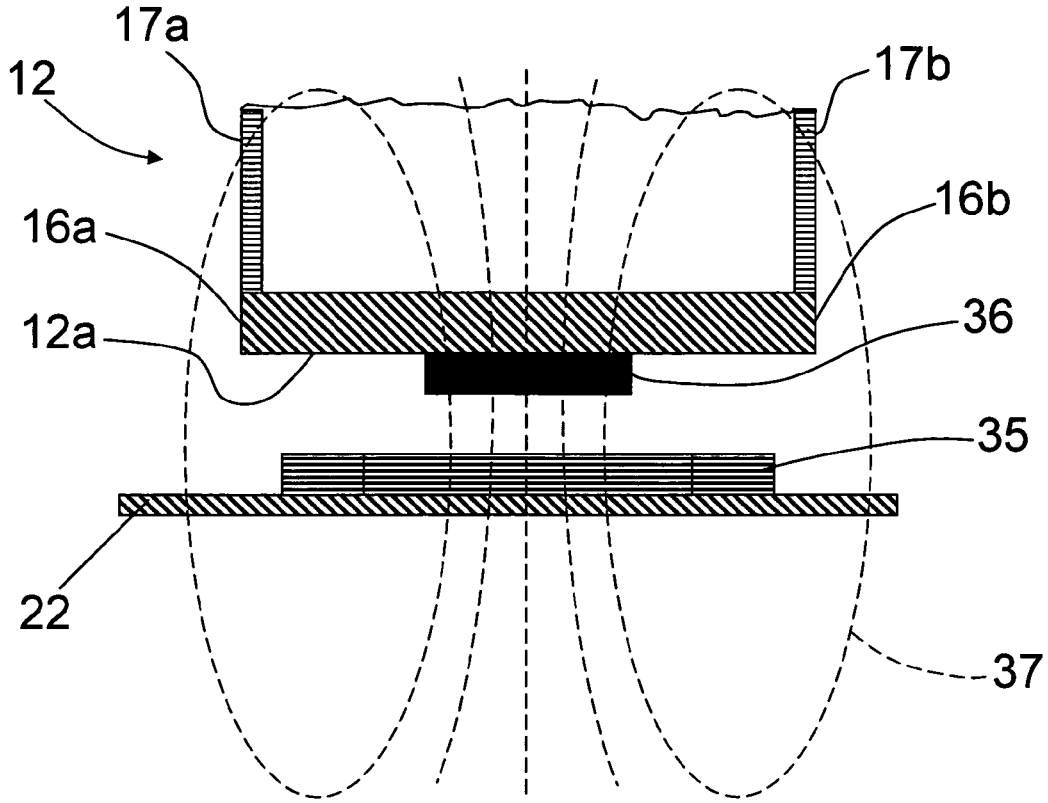
FIG. 14 illustrates, in a plan view partially sectioned, a detail of the filter and of the vibrating means of FIG. 13 during the vibration.

Another embodiment of the invention is illustrated in FIGS. 13 and 14.

In this case the exciter and the exciter-responsive element are arranged to be able to electromagnetically interact when the filter 12 is placed in the seat 11, in the operational position, so as to cause the exciter-responsive element (and consequently the filter 12) to vibrate.

Advantageously, as illustrated in FIG. 13, the exciter comprises a first solenoid coil 35, fixed to a lateral wall 22 of the seat 11, preferably with its axis parallel to the vibrating direction of the filter 12, and fed with an alternated current.

In a further embodiment, not illustrated in the enclosed Figures, the exciter could also be associated to the casing 2 outside the seat 11; in fact the connection with the exciter-responsive element is in this case obtained by an electromagnetic interaction, which doesn't need a mechanical connection between the two elements.

Opportunely the exciter-responsive element comprises at least a permanent magnet 36, associated (i.e. fixed, applied, attached) to the filter 12, externally or internally to the wall 12*a* facing the exciter when the filter 12 is in the operational position, or to a spacing element protruding from the lateral wall 12*a*, and arranged to interact with the alternated magnetic field (the flux lines of which are indicated with the reference number 37) generated by the first solenoid coil 35.

When an alternated current circulates in the first solenoid coil 35, it generates an alternated magnetic flux, which interacts with the permanent magnet 36, causing the latter (and consequently the filter 12) to vibrate.

Figure 15:
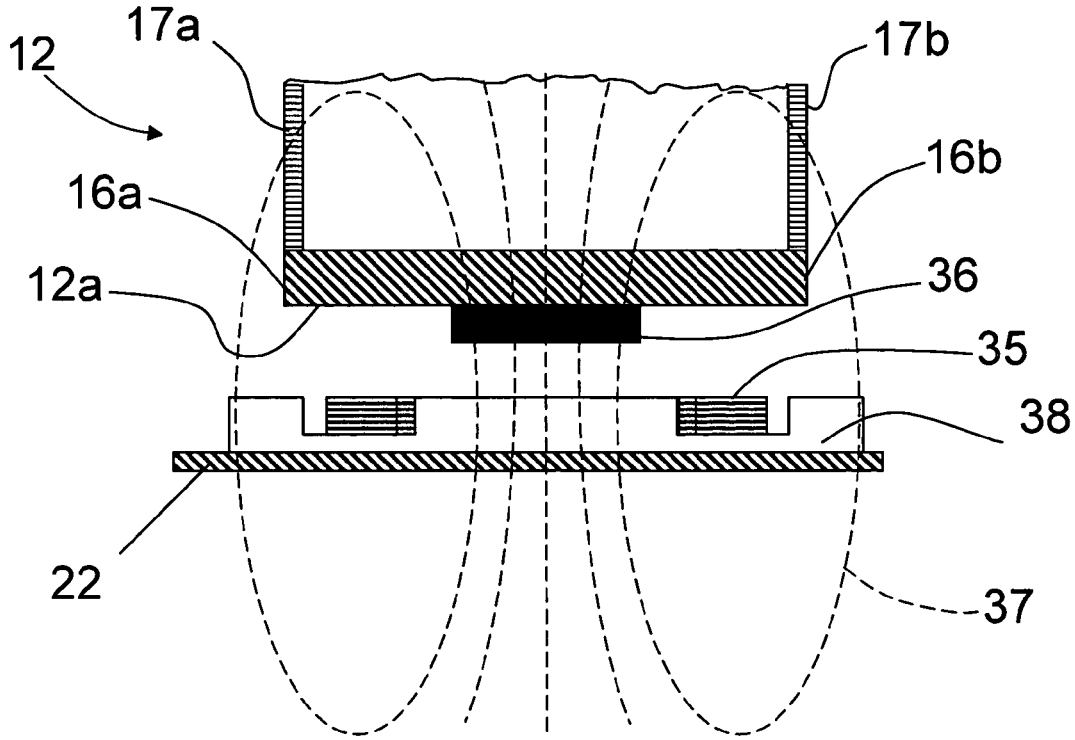
FIG. 15 illustrates, in a plan view partially sectioned, a detail of a filter and of the vibrating means of another embodiment of a laundry drying machine according to the invention.

In FIG. 15 is illustrated a further embodiment of the invention, in which the exciter comprises also a flux concentrator 38 around which it is wound the first solenoid coil 35; the flux concentrator 38 is advantageously a ferromagnetic element adapted to force the flux lines 37 of the magnetic field produced by the first solenoid coil 35 toward the permanent magnet 36, so as to increase the magnetic interaction between the first solenoid coil 35 and the permanent magnet 36.

Figure 16:
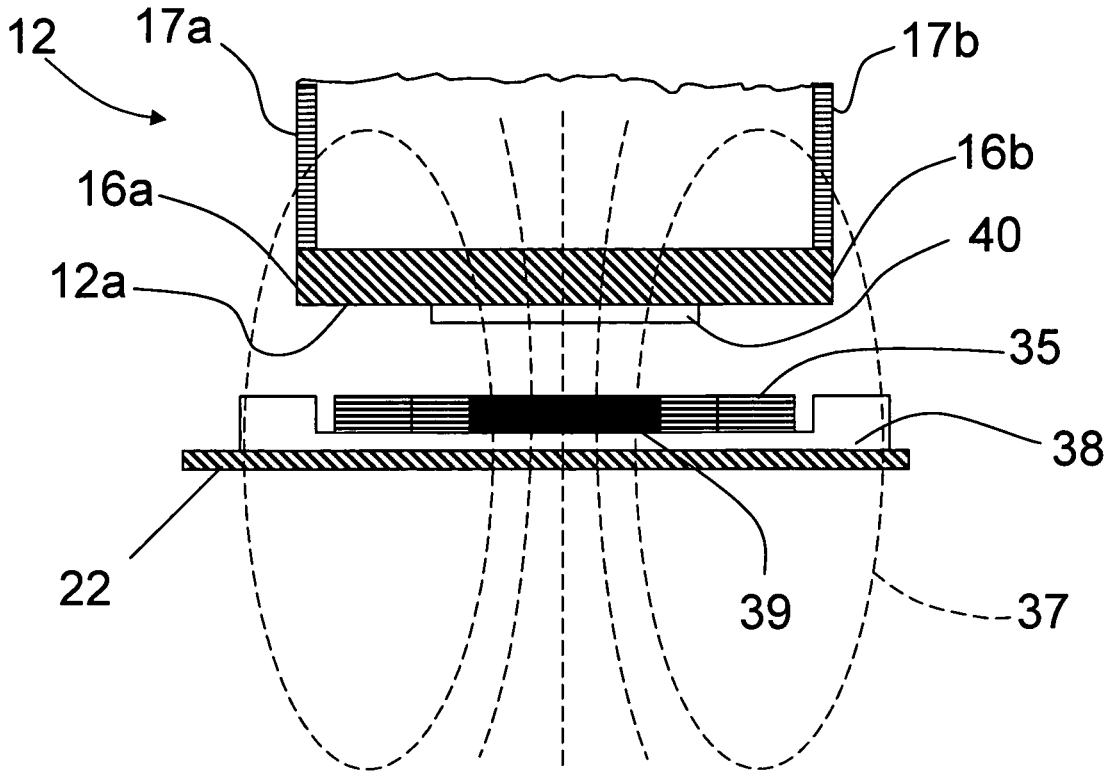
FIG. 16 illustrates, in a plan view partially sectioned, a detail of a filter and of the vibrating means of a further embodiment of a laundry drying machine according to the invention.

As can be seen in the embodiment illustrated in FIG. 16, in a further embodiment the permanent magnet 36, is replaced by a ferromagnetic element 40, and/or by a second solenoid coil (not illustrated) forming a close circuit, associated (i.e. fixed, applied, attached) to the filter 12; in fact the alternated magnetic flux generated by the first solenoid coil 35, linking this second element 40 and/or the second solenoid coil causes the ferromagnetic element 40 and/or the second solenoid coil to be magnetically attracted by the first solenoid coil 35.

In this case the current in the first solenoid coil 35 cyclically assumes a null value, so as to cyclically nullify the magnetic field produced by the first solenoid coil 35 and consequently interrupting the attraction of the filter 12; once interrupted this attraction, the intrinsic elasticity of the walls of the filter 12 causes the wall supporting the ferromagnetic element 40 and/or the second solenoid coil to vibrate. In this way the cyclic application of the magnetic field to the ferromagnetic element 40 and/or the second solenoid coil causes the filter to vibrate at a desired frequency, adapted to cause the fluff to fall down from the filtering septa 17*a*, 17*b*.

Advantageously, in the embodiment illustrated in FIG. 16 the exciter comprises also a further permanent magnet 39, disposed advantageously concentrically to the first solenoid coil 35 for increasing the magnetic attraction on the ferromagnetic element 40 and/or on the second solenoid coil (not illustrated); in this case the current in the first solenoid coil 35 is arranged in such a way that the combination of the magnetic field produced by its flowing in the first solenoid coil 35 and the magnetic field produced by the further permanent magnet 39, assumes cyclically a null value, so as to cyclically nullify the magnetic attraction of the filter 12 and causing the wall supporting the ferromagnetic element 40 and/or the second solenoid coil to vibrate.

Figure 17:
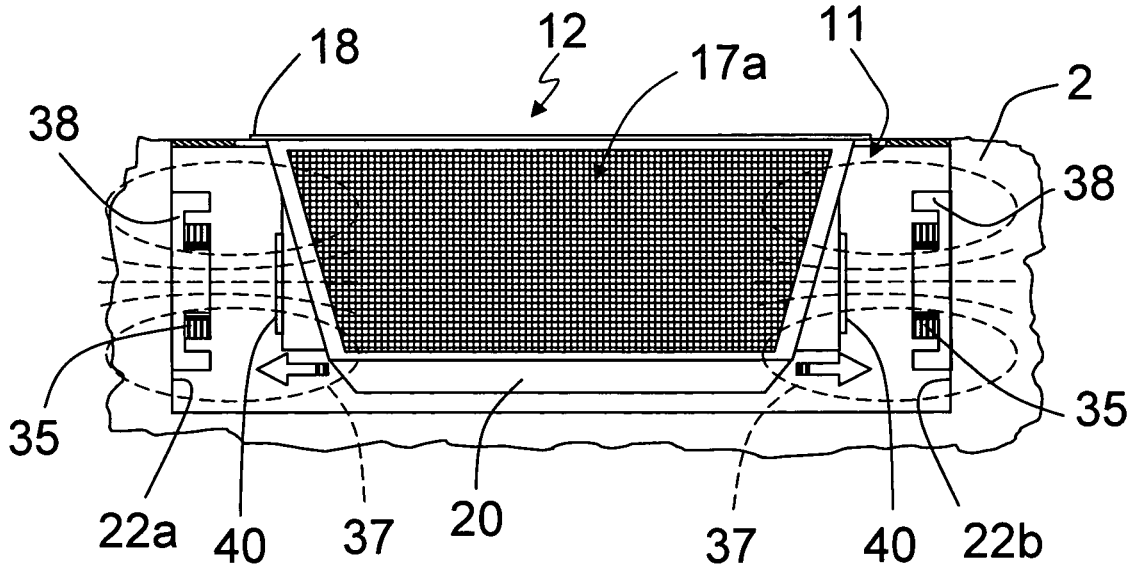
FIG. 17 illustrates, in a lateral view partially sectioned, a filter and the vibrating means of a laundry drying machine according to the invention.

In another embodiment of the present invention, illustrated in FIG. 17, there are two exciters, which can be analogous to the ones previously described with regard to FIGS. 13, 14, 15 and 16, associated to two opposite walls 22*a*, 22*b* of the seat 11; in this case there are two exciter-responsive elements, which can be analogous to the ones previously described with regard to FIGS. 13, 14, 15 and 16, associated to two lateral walls of the filter 12, each facing one exciter, so as to be linked by the magnetic flux produced by the contiguous exciter.

The alternated currents feeding the two first solenoid coils 35 have to be arranged so as to obtain a synchronous vibrations of the two mobile parts, thus increasing the vibrating force.

This can be for example obtained, if the two first solenoid coils 35 have the same spatial orientation (with respect to the so called "right hand grip rule"), by feeding these two first solenoid coils 35 with two alternated currents with opposite phases; the same result could also be achieved by feeding the two first solenoid coils 35 with the same alternated current, but inverting the spatial orientation of one of the two first solenoid coils 35 with respect to the other.

Advantageously the same effect could also be achieved, if the exciter-responsive elements comprise a permanent magnet 36, by feeding the two first solenoid coils 35 (supposing their spatial orientation being the same) with the same alternated current, and inverting the spatial orientation (i.e. the reciprocal orientation of their magnetic poles) of one of the two permanent magnets 36 with respect to the other.

It is seen therefore how the invention has achieved the proposed aim and objects, there being provided a laundry drying machine in which the cleaning of the fluff filter can be obtained automatically, consequently eliminating the above mentioned problems related to the possible negligence or difficulty in the manual cleaning of the filter.

In addition, in the laundry drying machine according to the invention the removal of the filter, for example to verify if the automatic cleaning of the latter has been effective, or to replace the filter in case of damage, or to clean manually the filter in case of need, can be achieved very easily and quickly.

Also the repositioning of the filter in the usage-position is achievable without effort or any particular attention, because the interaction between the exciter and the exciter-responsive device automatically places the filter, once introduced into the seat, in the right condition to be vibrated by the vibrating device.

The invention claimed is:

1. A laundry drying machine comprising a casing containing a rotatable drum for holding laundry to dry, a drying air circuit for conveying a drying air flow towards the inside of the drum and from it to the outside, at least one filter for intercepting fluff carried by the drying air flow, and a vibrator adapted to cause the filter to vibrate, so as to remove fluff from the filter, said vibrator comprising an exciter, attached to said casing, and an exciter-responsive element, attached to said filter, wherein said filter is selectively positionable between an operational position in which the filter is arranged in a seat intercepting said drying air circuit, and an extracted position in which the filter is removed from said seat, outside said drying air circuit and separated from said exciter, the exciter and the exciter-responsive element being adapted to reciprocally cooperate in order to cause the filter to vibrate when the filter is in the operational position in said seat, said exciter and said exciter-responsive element being configured to allow said filter to be slidably extracted from and inserted into the operational position in said seat without any separate detachment and attachment of said exciter from said exciter-responsive element, respectively.

2. A laundry drying machine according to claim 1, wherein said exciter comprises a vibrating surface facing said exciter-responsive element when said filter is in said operational position so as to cooperate with said exciter-responsive element for causing said filter to vibrate.

3. A laundry drying machine according to claim 2, wherein said vibrating surface directly contacts said exciter-responsive element when said filter is in said operational position, so as to transmit the vibration to said filter.

4. A laundry drying machine according to claim 2, wherein said exciter comprises a stinger protruding from said vibrating surface and arranged to push its free end against said exciter-responsive element when said filter is in the operational position.

5. A laundry drying machine according to claim 2, wherein said exciter comprises a first member of a male/female connector, and said exciter-responsive element comprises a second member of said male/female connector, said first member and second member being arranged to removably engage each other when the filter is in said operational position, so as to mechanically connect said exciter and said exciter-responsive element, and allowing the transmission of the vibration to said filter.

6. A laundry drying machine according to claim 2, wherein one of said exciter and said exciter-responsive element comprise at least a permanent magnet arranged to magnetically fasten said exciter and exciter-responsive element one to the other.

7. A laundry drying machine according to claim 6, wherein the other of said exciter and said exciter-responsive element comprise a ferromagnetic surface adapted to magnetically engage said permanent magnet.

8. A laundry drying machine according to claim 7, wherein said permanent magnet is associated to said vibrating surface and is arranged to magnetically fasten to a ferromagnetic surface of said exciter-responsive element comprising a ferromagnetic lateral wall of said filter facing the permanent magnet when the filter is in the operational position, or the ferromagnetic lateral surface of a spacing element protruding from said lateral wall, facing said permanent magnet when the filter is in said operational position.

9. A laundry drying machine according to claim 7, wherein said exciter-responsive element comprises said permanent magnet, which is adapted for matching with said exciter, said permanent magnet being associated to said lateral surface of said filter facing said exciter when said filter is in said operational position, said exciter comprising a ferromagnetic surface adapted to be magnetically fastened to said permanent magnet.

10. A laundry drying machine according to claim 1, wherein said exciter is an electrodynamic actuator, associated to a lateral wall of said seat and comprising a solenoid coil adapted to electromagnetically interact with a movable permanent magnet so as to cause said permanent magnet to vibrate.

11. A laundry drying machine according to claim 1, wherein said exciter and said exciter-responsive element are arranged to electromagnetically interact when said filter is in said operational position, so as to cause said exciter-responsive element to vibrate with respect to said exciter.

12. A laundry drying machine according to claim 11, wherein said exciter comprises a first solenoid coil for generating an alternated magnetic field, said exciter-responsive element comprising at least one of a permanent magnet, a ferromagnetic element and a second solenoid coil arranged to electromagnetically interact with the alternated magnetic field generated by said first solenoid coil when the filter is in the operational position, so as to cause the exciter-responsive element to vibrate.

13. A laundry drying machine according to claim 12, wherein said exciter comprises a flux concentrator around which it is wound said first solenoid coil, or a further permanent magnet, disposed substantially concentrically to said first solenoid coil.

14. A laundry drying machine according to claim 1, wherein said exciter-responsive element comprises a spacing element adapted to interact with said exciter so as to cause said filter to vibrate.

15. A laundry drying machine according to claim 1, wherein connected below said filter is a removable container, adapted to collect the fluff dropping down from the filter due to the vibrations.

16. A laundry dryer according to claim 1, said seat being situated at, and accessible by a user through, a laundry loading/unloading access opening to the inside of said rotatable drum.

17. A laundry dryer according to claim 6, wherein the exciter comprises said permanent magnet.

18. A laundry dryer according to claim 6, wherein the exciter-responsive element comprises said permanent magnet.

19. A laundry dryer according to claim 12, wherein said exciter-responsive element comprises said permanent magnet.

20. A laundry dryer according to claim 12, wherein said exciter-responsive element comprises said ferromagnetic element.

21. A laundry drying machine comprising a casing containing a rotatable drum for holding laundry to dry, a drying air circuit for conveying a drying air flow towards the inside of the drum and from it to the outside, at least one filter for intercepting fluff carried by the drying air flow, and a vibrator adapted to cause the filter to vibrate, so as to remove fluff from the filter, said vibrator comprising an exciter, attached to said casing, and an exciter-responsive element, attached to said filter, wherein said filter is selectively positionable between an operational position in which the filter is arranged in a seat intercepting said drying air circuit, and an extracted position in which the filter is removed from said seat, outside said drying air circuit and separated from said exciter, the exciter and the exciter-responsive element being adapted to reciprocally cooperate in order to cause the filter to vibrate when the filter is in the operational position in said seat, said exciter and said exciter-responsive element being configured to allow said filter to be extracted from and inserted into the operational position in said seat without any separate detachment and attachment of said exciter from said exciter-responsive element, respectively, said seat being situated at, and accessible by a user through, a laundry loading/unloading access opening to the inside of said rotatable drum.

* * * * *